US006797901B2

(12) United States Patent
Kondoh et al.

(10) Patent No.: US 6,797,901 B2
(45) Date of Patent: Sep. 28, 2004

(54) SWITCH DEVICE AND METHOD OF MAKING SAME

(75) Inventors: You Kondoh, Yamato (JP); Mitsuchika Saito, Kanagawa (JP)

(73) Assignee: Agilent Technologies, Inc., Palo Alto, CA (US)

( * ) Notice: Subject to any disclaimer, the term of this patent is extended or adjusted under 35 U.S.C. 154(b) by 89 days.

(21) Appl. No.: 10/177,036

(22) Filed: Jun. 21, 2002

(65) Prior Publication Data

US 2003/0234166 A1 Dec. 25, 2003

(30) Foreign Application Priority Data

Dec. 22, 1999 (JP) ..... 11-364604

(51) Int. Cl.[7] ..... H01H 29/00

(52) U.S. Cl. ..... 200/187; 200/191; 200/214; 200/233; 337/21; 337/326

(58) Field of Search ..... 200/81.6, 187, 200/188, 191, 214, 233, 234, 235, 81.4, 81.5, 81 R; 337/21, 119, 122, 309, 326

(56) References Cited

U.S. PATENT DOCUMENTS

| | | | | |
|---|---|---|---|---|
| 3,249,772 A | | 5/1966 | Lindberg | |
| 3,646,490 A | * | 2/1972 | Bitko | 200/234 |
| 4,371,753 A | * | 2/1983 | Graf | 200/187 |
| 5,726,404 A | * | 3/1998 | Brody | 200/81 R |
| 6,323,447 B1 | * | 11/2001 | Kondoh et al. | 200/214 |

FOREIGN PATENT DOCUMENTS

| | | |
|---|---|---|
| EP | 1179829 A1 | 2/2002 |
| FR | 699243 | 12/1930 |
| JP | 51-1309 | 1/1976 |
| JP | 09-161640 | 6/1996 |

OTHER PUBLICATIONS

Simon, Jonathan et al., "A Micromechanical Relay with a THermally–Driven Mercury Micro–Drop", Proceedings of Wordshop on Micro Electro Mechanical System, Feb. 11–15, 1996, pp. 515–520.

Simon, Jonathan et al., "A Liquid–Filled Microrelay with a Moving Mercury Microdrop", Journal of Microelectromechanical Systems, vol. 6, No. 3, Sep. 1997, pp. 208–216.

* cited by examiner

*Primary Examiner*—Renee Luebke

(57) ABSTRACT

The switch device comprises a pair of cavities, an elongate passage, a non-conductive fluid having a high electrical resistance, a conductive fluid having a high electrical conductivity and an electrical path. The passage is in fluid communication with the cavities and has a substantially elliptical cross-section over at least part of its length. The non-conductive fluid is disposed in each of the cavities. The conductive fluid is located in the passage. The electrical path is changeable between a connected state and a disconnected state by the non-conductive fluid separating the conductive fluid in the passage into non-contiguous conductive fluid portions.

19 Claims, 5 Drawing Sheets

SWITCH DEVICE AND METHOD OF MAKING SAME

BACKGROUND OF THE INVENTION

Published Japanese Patent Application No. S47-21645 discloses an example of a switch device for electrically switching solid electrodes by means of a conductive fluid. In this switch device, a conductive fluid composed of a liquid such as mercury is disposed movably inside a cylinder. The switch device is designed so that the conductive fluid is moved to one side by a pressure differential in a gas provided on both sides of the conductive fluid. When the conductive fluid moves, it touches electrodes that extend into the interior of the cylinder and forms an electrical connection between the electrodes. A drawback to this structure, however, is that the electrical connection characteristics of the switch device deteriorate as a result of the surfaces of the electrodes being modified over time by intermittent contact with the conductive fluid.

U.S. Pat. No. 6,323,447 of Kondoh et al., assigned to the assignees of this disclosure and incorporated herein by reference, discloses a switch device structure that solves the above-mentioned problem. In this switch device structure, the electrical path is selectively changed from a connected state to a disconnected state by a conductive fluid such as mercury. However, the electrodes remain in constant contact with part of the conductive fluid, and the connected or disconnected state of the electrical path is determined by whether the conductive fluid exists as a single entity (connected state) or is separated into two or more conductive fluid portions (disconnected state). This eliminates the problem of poor connections that was a disadvantage of the switch device disclosed in published Japanese Patent Application No. S47-21645.

In the switch device disclosed in U.S. Pat. No. 6,323,447, the material of the wall of the passage in which the conductive fluid is located has a low wettability with respect to the conductive fluid. Moreover, conventional manufacturing methods, such as anisotropically etching silicon, other types of dry etching, or a method such as applying a dry film, for forming the passage form the passage with a triangular, square, rectangular, trapezoidal or semicircular cross-sectional shape.

FIG. 1 is a cross-sectional view of the passage of a typical prior art switch device. The passage 510 is formed in the silicon substrate by anisotropic etching. This design was proposed by J. Simon et. al. in 6 J. MICROELECTROMECHANICAL SYS, 206–216 (September 1997). The passage 510 has a triangular cross-sectional shape. The surface tension of the conductive fluid 520 causes the mercury to accumulate in the middle the passage, leaving gaps between the conductive fluid and the corners of the passage. Such gaps allow the non-conductive fluid to leak from the high-pressure side to the low-pressure side during operation of the switch device, which reduces the ability of the non-conductive fluid to move the conductive fluid. The effectiveness of the non-conductive fluid to move the conductive fluid can be increased by increasing the capacity of the device, such as a heater, that increases the pressure in the high-pressure side. However, when a heater is used as the pressure increasing device, increasing its capacity requires that the heater have a larger surface area or that it dissipate greater power. This not only increases the size of the switch device and increases the power consumption, but also towers the degree of freedom in design.

SUMMARY OF THE INVENTION

The invention solves the above problems, and provides a switch device that is more compact and uses less power than the conventional switch devices described above. The improvements are accomplished by reducing the leakage of the non-conductive fluid from the high-pressure side to the low-pressure side during operation of the switch device.

The invention provides a switch device comprising a pair of cavities, an elongate passage, a non-conductive fluid having a high electrical resistance, a conductive fluid having a high electrical conductivity and an electrical path. The passage is in fluid communication with the cavities and has a substantially elliptical cross-section over at least part of its length. The non-conductive fluid is disposed in each of the cavities. The conductive fluid is located in the passage. The electrical path is changeable between a connected state and a disconnected state by the non-conductive fluid separating the conductive fluid in the passage into non-contiguous conductive fluid portions.

The invention additionally provides a switch device comprising a pair of cavities, an elongate passage, a non-conductive fluid having a high electrical resistance, a conductive fluid having a high electrical conductivity and a wettable material. The passage is in fluid communication with the pair of cavities. The passage has a cross-sectional shape that, over at least a portion of the length of the passage, includes a corner. The non-conductive fluid is located in each of the pair of cavities. The conductive fluid is located in the passage in contact with the non-conductive fluid from the each of the cavities. The wettable material is wettable by the conductive fluid, is in contact with the conductive fluid and is located in at least part of the portion of the length of the passage where the cross-sectional shape includes the corner.

Finally, the invention provides a method of making a switch device. In the method, a pair of plates, a non-conductive fluid having a high electrical resistance and a conductive fluid having a high electrical conductivity are provided. A pair of cavities and a passage that allows the pair of cavities to communicate are formed in at least one of the plates The passage has a cross-sectional shape that includes a corner over at least part of its length. The plates are mated. A portion of the non-conductive fluid is placed in each of the cavities. The conductive fluid is placed in the passage in contact with the portion of the non-conductive fluid in each of the cavities. A wettable film that is wettable by the conductive fluid is formed on at least one of the plates. The wettable film is located adjacent the corner of the cross-sectional shape and extends widthways and lengthways in the passage when the pair of plates is mated.

DETAILED DESCRIPTION OF THE INVENTION

Preferred embodiments of the switch device according to the invention will now be described in detail with reference to the Figures.

Figure 1:
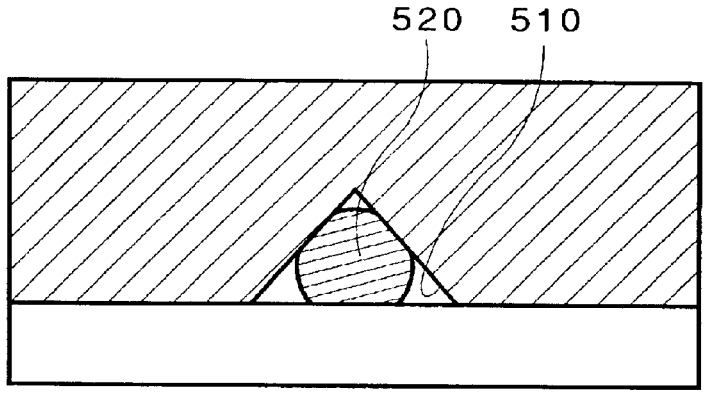
FIG. 1 is a cross sectional view of the channel of a conventional switch device.
Figure 2:
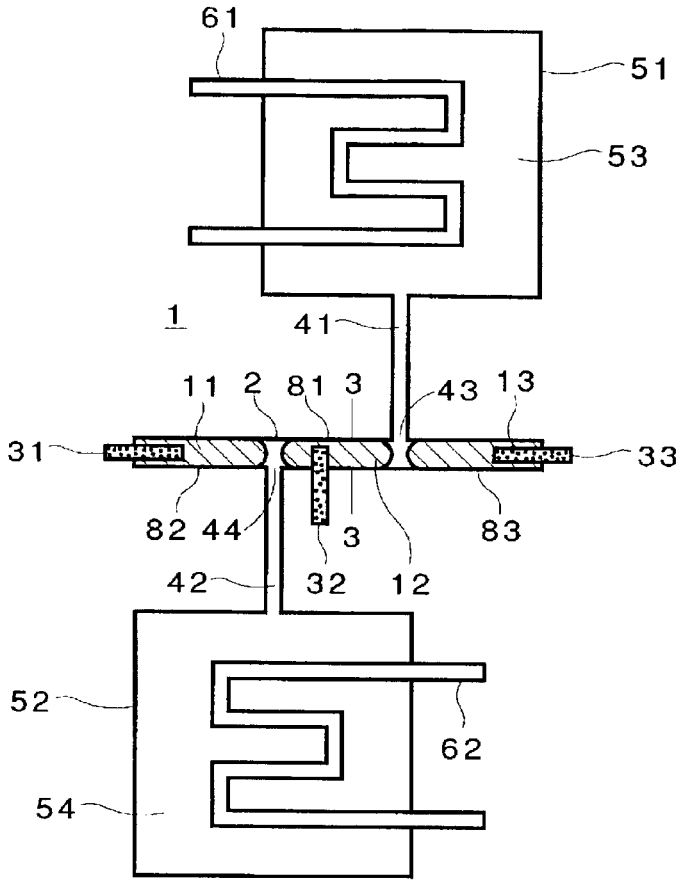
FIG. 2 is a plan view showing the structure of a first embodiment of a switch device according to the invention.
Figure 3:
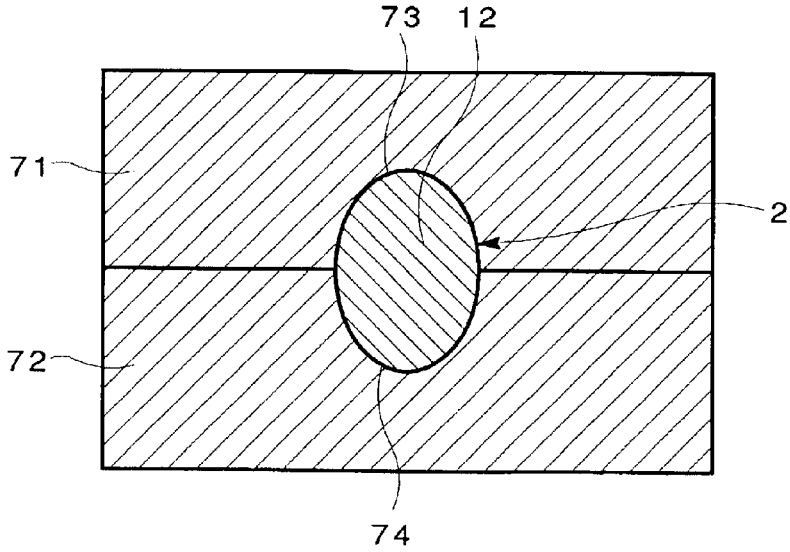
FIG. 3 is a cross-sectional view along the line 3—3 in FIG. 2.

FIGS. 2 and 3 show the structure of a first embodiment 1 of a switch device according to the invention. Three electrodes 31, 32, and 33 are disposed along the length of the elongate passage 2 that is partially filled with a conductive fluid. The electrode 32 will be called the center electrode. The conductive fluid is shown separated into the three conductive fluid portions 11, 12, and 13 that contact the electrodes 31, 32, and 33, respectively.

The conductive fluid is preferably mercury. Gallium or another conductive material that is fluid at the operating temperature of the switch device may alternatively be used.

Channels 41 and 42 extend from the cavities 51 and 52, respectively, to the outlets 43 and 44, respectively, laterally offset from one another along the length of the passage between the electrode 32 and the electrode 33, and between the electrode 31 and the electrode 32, respectively. The cavities 51 and 52 are filled with the non-conductive fluid 53 and 54, respectively. Heaters 61 and 62 are located in the cavities 51 and 52, respectively, for regulating the internal pressure of the non-conductive fluid in the cavities. The channels 41 and 42 transfer the non-conductive fluid from the cavities 51 and 52, respectively, into the passage 2.

The switching operation of the switch device 1 is the same as of the switch device described in published Japanese Patent Application No. 2000-195389. For example, the conductive fluid portions 12 and 13 are initially joined together to form the conductive fluid 12, 13, separated from the conductive fluid portion 11. Thus, the conductive fluid 12, 13 electrically connects the electrode 32 to the electrode 33, but the gap between the conductive fluid 12, 13 and the conductive fluid portion 11 electrically isolates the electrode 32 from the electrode 31.

The heater 61 generating heat causes the non-conductive fluid 53 in the cavity 51 to expand. The non-conductive fluid may be a gas, such as nitrogen, for example. The non-conductive fluid 53 passes through the channel 41 and enters the passage 2 through the outlet 43. In the passage, the non-conductive fluid forms a gap in the conductive fluid 12, 13. The gap separates the conductive fluid 12, 13 into the non-contiguous conductive fluid portions 12 and 13. Separation of the conductive fluid 12, 13 into the conductive fluid portions 12 and 13 closes the gap between the conductive fluid portions 11 and 12. The conductive fluid portions 11 and 12 unite to form the conductive fluid 11, 12. The conductive fluid 11, 12 electrically connects the electrode 32 to the electrode 31. The gap between the conductive fluid portion 13 and the conductive fluid 11, 12 electrically isolates the electrode 33 from the electrode 32.

The reverse operation occurs when the heater 62 generates heat. The non-conductive fluid 54 in the cavity 52 flows through the channel 42 into the passage 2 to form a gap in the conductive fluid 11, 12. The gap electrically isolates the electrode 32 from the electrode 31. Formation of the gap unites the conductive fluid portions 12 and 13 to form the conductive fluid portion 12, 13. The conductive fluid 12, 13 electrically connects the electrodes 32 and 33.

The first embodiment of the invention provides an improvement in the cross-sectional shape of the passage 2 in the switch device just described to increase the operational efficiency and to reduce the size of the switch device.

As shown in the cross-sectional view of FIG. 3, the passage 2 in this embodiment is composed of the grooves 73 and 74 formed in corresponding positions in the major surfaces of the first substrate 71 and the second substrate 72, respectively. Joining the substrates together with their major surfaces in contact and the grooves 73 and 74 aligned with one another forms the passage 2. Formed as described, the passage 2 has a substantially elliptical cross-sectional shape, as can be seen in FIG. 3. In this disclosure, unless otherwise stated, the term elliptical will be understood to encompass circular, the special case of the term elliptical in which the major and minor axes are of equal length. Similarly, the term semi-elliptical will be understood to encompass semicircular.

The preferred material if the substrates 71 and 72 is glass. The grooves 73 and 74 have a substantially semi-elliptical cross-sectional shape and are about 0.1 to 0.2 mm wide and about 0.1 mm deep. The grooves are preferably formed in the substrates 71 and 72 by sandblasting with alumina particles, for instance. FIG. 3 also shows that, when the conductive fluid 12 is put into the passage 2 having an elliptical cross-sectional shape, the gap, if any, that exists between the conductive fluid 12 and the wall of the passage is very small.

The conductive fluid 12 can be put into the passage 2 at the same time as the substrates 71 and 72 are joined together. Alternatively, the conductive fluid can be put in the groove formed in one of the substrates 71 and 72 before the substrates are joined. As a further alternative, the conductive fluid can be put into the passage 2 after the passage has been formed by joining the substrates 71 and 72 together.

In a switch device having a passage 2 with an elliptical cross-sectional shape, and preferably formed by the method just described, the gap, if any, between the conductive fluid and the wall of the passage 2 is very small, as shown in the cross-sectional view of FIG. 3. Accordingly, the switch device 1 is subject to almost no pressure leakage or gas exchange past the conductive fluid 12, and any increase in the pressure in each of the cavities 51 and 52 separates the conductive fluid into conductive fluid portions more efficiently. This allows the size of the heaters 61 and 62 to be reduced compared with a conventional switch device, or allows the heaters to be operated at lower power.

In the embodiment just described, the number of component parts is reduced by forming the grooves 73 and 74 in both of the substrates 71 and 72 and by making the cross-sectional shapes of the portions 82 and 83 of the passage 2 and of the channels 41 and 42 similar to that shown in FIG. 3. However, according to the invention, only the portion 81 of the passage 2 that extends between the openings 43 and 44 of the channels 41 and 42, respectively, must have a substantially elliptical cross-sectional shape and are preferably formed by forming grooves having a substantially semi-elliptical cross-sectional shape in both of the first and second substrates 71 and 72. The portions 82 and 83 of the passage 2 and the channels 41 and 42 may alternatively have a semi-elliptical cross-sectional shape and may be formed by forming a groove in only one of the substrates 71 and 72.

Figure 4:
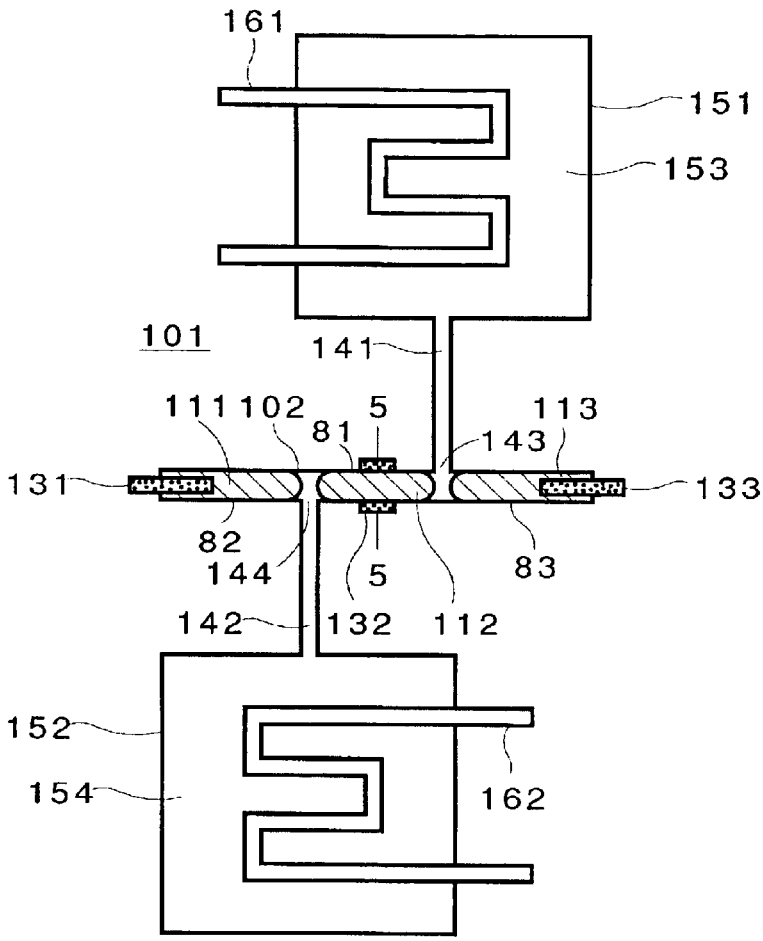
FIG. 4 is a plan view showing the structure of a second embodiment of a switch device according to the invention.
Figure 5:
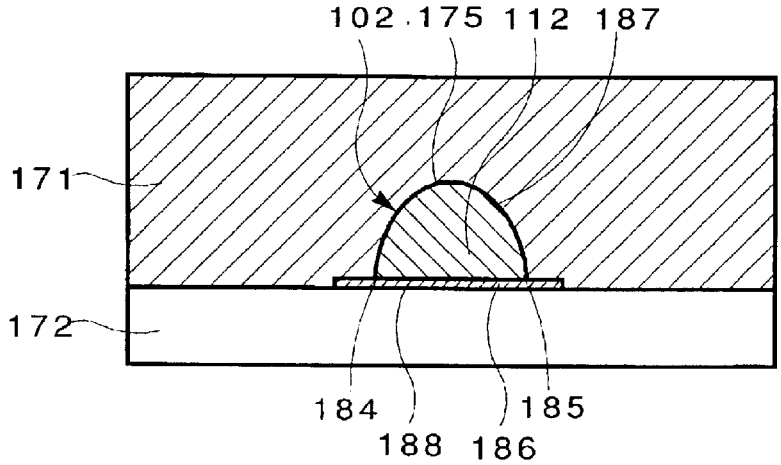
FIG. 5 is a cross-sectional view along the line 5—5 in FIG. 4.

FIGS. 4 and 5 illustrate a second embodiment 101 of a switch device according to the invention. The second embodiment of the switch device shown in FIGS. 4 and 5 is similar to the first embodiment of the switch device shown in FIGS. 2 and 3. Elements of the second embodiment having a similar function to elements of the first embodiment are indicated using the same reference numerals with 100 added and will not be described again.

In the second embodiment 101, the passage 102 has a semi-elliptical cross-sectional shape. The cross-sectional shape includes the corners 184 and 185 between the straight portion 186 and the semi-elliptical portion 187. The wettable metal film 188 is located on a portion of the major surface of the substrate 172 that bounds part of the passage 102.

The preferred way of forming the passage 102 with a semi-elliptical cross-sectional shape is by forming the groove 175 having a semicircular or semi-elliptical cross-sectional shape in the first substrate 171 and joining the first substrate 171 to the first substrate 172 in which no groove is formed, as shown in FIG. 5.

The wettable metal film 188 is located on part of the major surface of the substrate 172 in a region located at or near half-way between the openings 143 and 144 of the channels 141 and 142. The wettable metal film extends lengthways along the length of the passage 102 towards both openings. The wettable metal film additionally extends widthways preferably at least as far as the corners 184 and 185 between the groove 175 and the substrate 172. FIG. 5 shows the wettable metal film extending beyond this corner to ensure that the wettable metal film is present at the corners 184 and 185 notwithstanding alignment errors between the substrates 171 and 172.

The material of the wettable metal film 184 is a metal that is wetted by the conductive fluid 112. Preferably, the wettable metal film is composed of thin films of chromium, nickel and gold. These films are deposited in order by vacuum deposition on the major surface of the substrate 172 to form the desired shape of the wettable metal film. Alternatively, the wettable metal film can include platinum, copper, tungsten, molybdenum, titanium, tantalum, iron, cobalt, palladium, or a combination of two or more of these metals. In the example shown, the wettable metal film also serves as the center electrode and is indicated as such by the reference numeral 132 in FIG. 5. However, this is not critical to the invention. The switch device may additionally include a center electrode separate from the wettable metal film.

The preferred material of the substrates 171 and 172 is glass, and the groove 175 is preferably formed in the first substrate 171 by sandblasting with particles such as alumina.

In a preferred embodiment, all three electrodes 131, 132 and 133 are formed simultaneously by the same thin film deposition process.

In the second embodiment 101 of the switch device that includes the wettable metal film 188 located part-way along the length of the passage 102, the gap, if any, between the conductive fluid 112 and the passage is very small, as shown in the cross-sectional view of FIG. 5. The small size of the gap is due to the effect of the semi-elliptical cross-sectional shape of the passage in the portion of the cross section of the passage having this cross-sectional shape, and the conductive fluid wetting the wettable metal film in the vicinity of the corners 184 and 185 between the semi-elliptical portion 187 and the straight portion 186 of the cross-sectional shape. Accordingly, the switch device 101 is subject to almost no pressure leakage or gas exchange past the conductive fluid, and any increase in the pressure in each of the cavities 151 and 152 moves or deforms the conductive fluid more efficiently. This allows either or both of the size and power dissipation of the heaters 161 and 162 to be reduced compared with a conventional switch device.

An advantage of the second embodiment 101 over the first embodiment 1 is that there is no need to form a groove in both of the substrates. Additionally, whereas the efficiency of the first embodiment may be reduced if the alignment between the substrates 71 and 72 is not correct, the second embodiment provides some alignment tolerance by making the wettable metal film 188 located on the second substrate 172 wider than the width of the groove 175 formed on the first substrate 171, as noted above.

Figure 6:
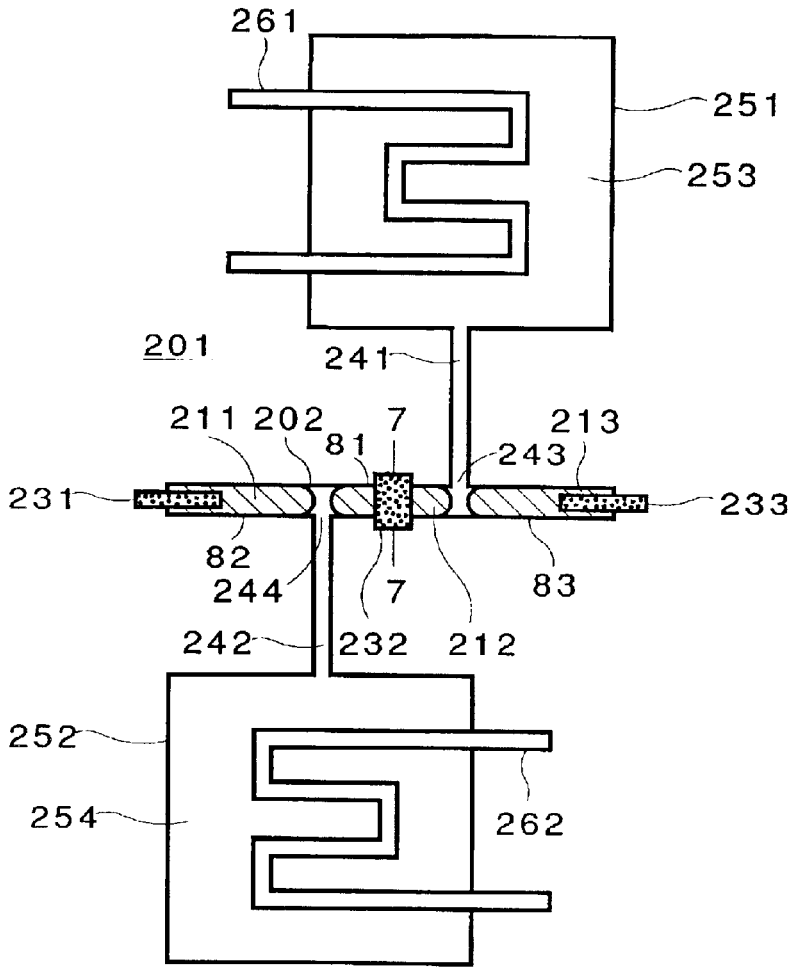
FIG. 6 is a plan view showing the structure of a third embodiment of a switch device according to the invention.
Figure 7:
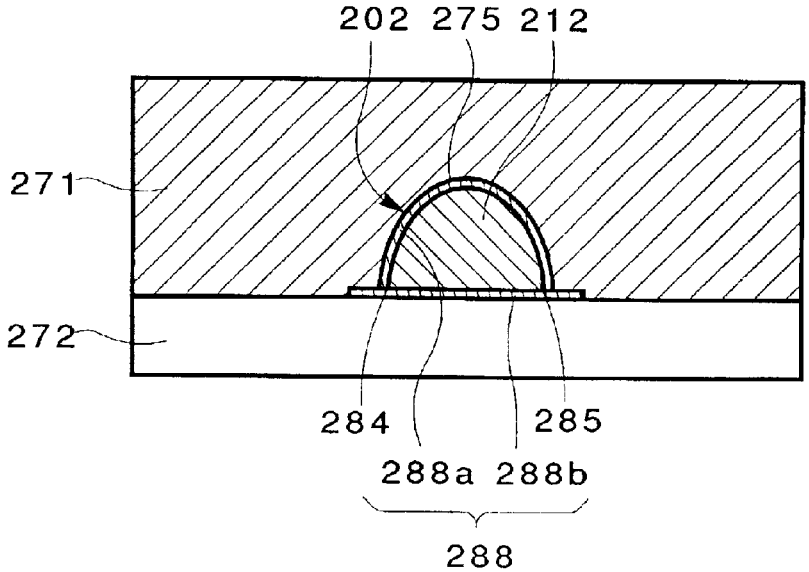
FIG. 7 is a cross-sectional view along the line 7—7 in FIG. 6.

FIGS. 6 and 7 illustrate a third embodiment 201 of a switch device according to the invention. Elements of the third embodiment having a function similar to elements of the first embodiment 1 are indicated using the same reference numerals with 200 added and will not be described again. In the third embodiment, the wettable metal film 288 is located both on the major surface of the substrate 272 and in the groove 275 formed in the substrate 271, and therefore substantially surrounds the passage 202. The wettable metal film is located at or near half-way between the openings 243 and 244 of the channels 241 and 242, respectively. The wettable metal film extends lengthways along the length of the passage 202 towards both openings. The wettable metal film extends widthways to surround the passage 202.

The third embodiment 201 of the switch device is made using a process similar to that described above for making the second embodiment 101. However, after the groove 275 has been formed in the substrate 271, metal films of chromium, nickel, and gold are deposited in order by masked vapor deposition into the groove 275 to form the wettable metal film portion 288*a*. The wettable metal film portion 288*b* is also formed approximately in the middle of the major surface of the second substrate 272. The wettable metal film portion 288*b* is also formed by vapor depositing and patterning thin films of chromium, nickel, and gold in that order.

In the example shown, the wettable metal film 288 also serves as the center electrode and is indicated as such by the reference numeral 232 in FIG. 7. However, this is not critical to the invention, as noted above.

The gap, if any, between the conductive fluid 212 and the passage 202 is very small, as shown in the cross-sectional view of FIG. 7. This is because the entire the region of the passage 202 that is surrounded by the wettable metal 288 is wetted by the conductive fluid 212. Accordingly, the third embodiment of the switch device can be driven with lower power and more efficiently than the first and second embodiments.

Figure 8:
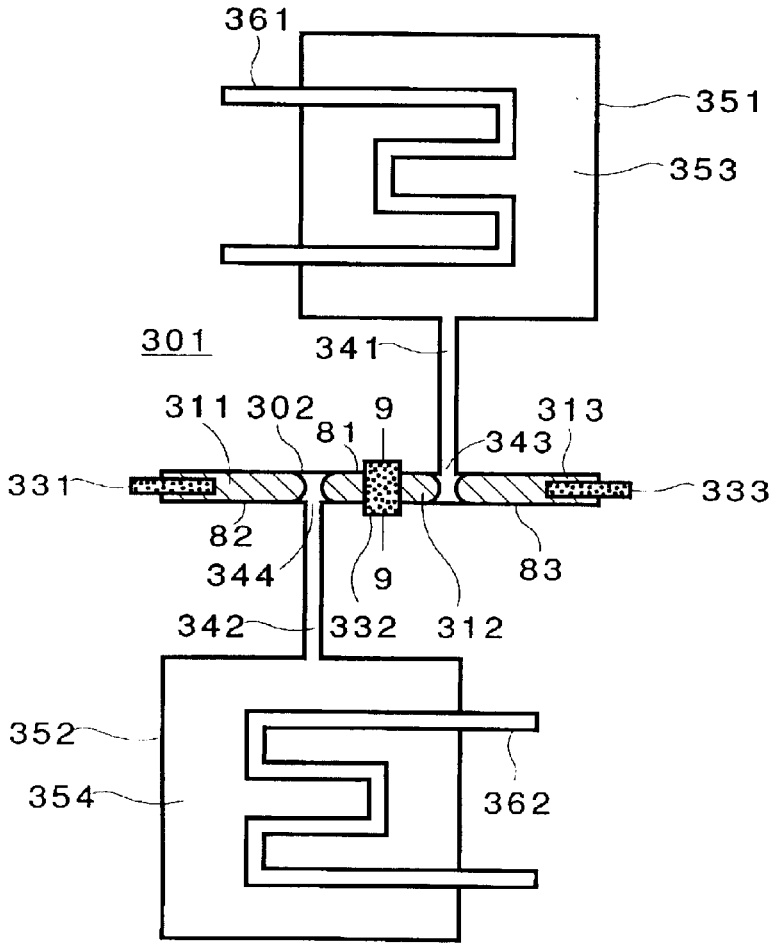
FIG. 8 is a plan view showing the structure of a fourth embodiment of a switch device according to the invention.
Figure 9:
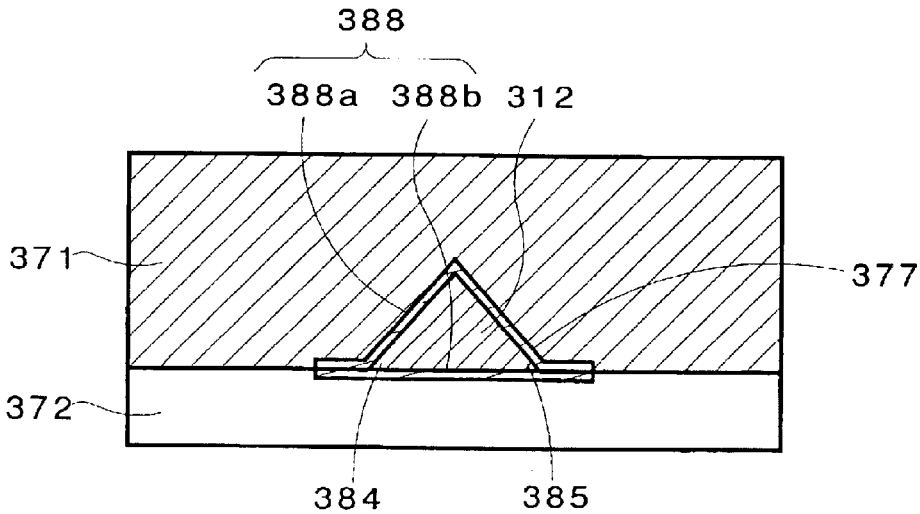
FIG. 9 is a cross-sectional view along the line 9—9 in FIG. 8.

FIGS. 8 and 9 illustrate a fourth embodiment 301 of a switch device according to the invention. Elements of the fourth embodiment having a function similar to elements of the first embodiment 1 are indicated using the same reference numerals with 300 added and will not be described again. In the fourth embodiment, the passage 302 has a polygonal cross-sectional shape. In the example shown in FIG. 9, the passage 302 has a triangular cross-sectional shape as the most critical example of a polygonal shape.

The preferred material of the first substrate 371 in the fourth embodiment is silicon. The silicon substrate is anisotropically etched using potassium hydroxide or another suitable etchant to form the groove 377 with a triangular cross section. As in the third embodiment, the wettable metal film 388 surrounds the passage 302 in a region centered on the mid-point between the outlets 343 and 344 of the channels 341 and 342. The wettable metal film portion 388*a* is deposited in approximately half-way along the length of the groove 377 and the wettable metal film portion 388*b* is deposited approximately in the middle of the major surface of the second substrate 372. The wettable metal film portions are formed by vapor depositing and patterning thin films of chromium, nickel, and gold in that order.

Notwithstanding the triangular cross-sectional shape of the passage 302, the gap, if any, between the conductive fluid 312 and the passage 302 is very small, as shown in the cross-sectional view of FIG. 9. This is because the entire region of the passage 302 that is surrounded by the wettable metal film is wetted by the conductive fluid 312.

Unlike the embodiments 1, 101 and 201 described above, the fourth embodiment 301 can be fabricated using anisotropic etching. Forming the groove 377 using anisotropic etching enables the dimensions of the groove to be controlled more accurately. This enables the groove to be made narrower and the entire switch device to be made smaller. Similar advantages are obtained when conventional dry etching is used instead of anisotropic wet etching. Furthermore, the wettable metal film 388 was made by masked vapor deposition in the example described. However, the wettable metal film can alternatively be made using a resist formation method involving plating, for example.

The structure for minimizing the size of the gap between the conductive fluid and the inner walls of the passage was described above as being provided in the central region 81 of the passage 2 between the outlets 43 and 44 of the channels 41 and 42 connecting the passage to the cavities 51 and 52. However, it is advantageous to provide this structure additionally in the outer regions 82 and 83 of the passage. The outer regions having such a structure latches the separated conductive fluid portions at specified locations when the conductive fluid is separated as shown in the Figures. This provides smoother and more reliable operation of the switch device.

Accordingly, a method and apparatus have been provided for reducing the size, improving the efficiency, and reducing the power consumption of a miniature switch device in which a conductive fluid is used.

Implementing the present invention yields a switch device that is higher in efficiency, smaller in size, and lower in cost than conventional switch devices. By minimizing or eliminating the gap between the conductive fluid and the passage, the increased internal pressure generated by the heater in one of the cavities will not leak into the other cavity, so the capability of the heater to separate the conductive fluid is maximized. Accordingly, the switch device can be produced with a smaller heater, or the heater can be driven at a lower power, among other advantages.

One advantage of the present invention is that it provides a switch device that is more compact and uses less power. This is accomplished by reducing the leakage from the high-pressure side to the low-pressure side during operation of the switch device.

According to the invention, a switch device that includes a small amount of a conductive fluid can be made smaller, its efficiency increased, and its power consumption reduced by defining the one or both of the cross-sectional shape and surface properties of the passage in which the conductive fluid is located as follows:

(1) The cross-sectional shape of the passage is substantially elliptical;

(2) The cross-sectional shape of the passage is substantially semi-elliptical and the cross-sectional shape includes a straight portion made from a wettable material that is wetted by the conductive fluid; and (3) The cross-sectional shape of the passage is polygonal and the inner wall of the passage is made of a wettable material that is wetted by the conductive fluid.

The terms elliptical and semi-elliptical as used in this disclosure not only express pure mathematical shapes but also express shapes that approximate such mathematical shapes. Moreover, these shapes ignore fine irregularities that may exist in the surface of the inner wall of the passage. Additionally, there may be irregularities that are discontinuous in the lengthwise direction on the inner wall.

When a drop of a conductive fluid, e.g., mercury, is put in a passage adjacent a non-conductive fluid, e.g., nitrogen gas, the conductive fluid will have a radius of curvature that is equal to or greater than the radius of curvature of the surface of the conductive fluid in contact with the non-conductive fluid. As a result, the gap will exist, but the gap will be no more than a few microns wide.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto, and their equivalents.

We claim:

1. A switch device, comprising:

a pair of cavities;

an elongate passage in fluid communication with the cavities, the passage having a length and having a substantially elliptical cross-section over at least part of its length;

a non-conductive fluid having a high electrical resistance disposed in each of the cavities;

a conductive fluid having a high electrical conductivity located in the passage; and an electrical path changeable between a connected state and a disconnected state by the non-conductive fluid separating the conductive fluid in the passage into non-contiguous conductive fluid portions.

2. The switch device of claim 1, in which:

the switch device additionally comprises a pair of plates; and the passage comprises opposing grooves, one in each of the plates, the grooves extending into the plates in a depth direction and having a substantially semi-elliptical cross section.

3. The switch device of claim 2, wherein the grooves are formed by sandblasting.

4. The switch device of claim 1, in which:

the switch device additionally comprises a channel extending from each of the cavities and terminating in an opening in the passage; and the passage has the substantially semi-elliptical cross section in a portion of its length between the openings.

5. The switch device of claim 1, in which:

the switch device additionally comprises a channel extending from each of the cavities and terminating in an opening in the passage;

during operation, the non-conductive fluid separates the conductive fluid into the conductive fluid portions located in the passage at separation locations positioned on both sides of at least one of the openings; and the passage has the substantially semi-elliptical cross section in portions of its length that correspond to the separation locations.

6. A switch device, comprising:

a pair of cavities;

an elongate passage in fluid communication with the pair of cavities, the passage having a length and a cross-sectional shape, the cross-sectional shape over at least a portion of the length of the passage including a corner;

a non-conductive fluid having a high electrical resistance disposed in each of the pair of cavities;

a conductive fluid having a high electrical conductivity located in the passage and in contact with the non-conductive fluid from each of the cavities; and a wettable material wettable by the conductive fluid, the wettable material being in contact with the conductive fluid and being located in at least part of the portion of the length of the passage where the cross-sectional shape includes the corner.

7. The switch device of claim 6, in which:

the switch device additionally comprises a mated pair of plates;

the pair of cavities and the passage are formed in the mated pair of plates;

at least part of the passage that is substantially in contact with the conductive fluid is formed by disposing a groove made in one of the mated pair of plates opposite a major surface of the other of the mated pair of plates to form the corner at the intersection between the groove in the one of the mated pair of plates and the major surface of the other of the mated pair of plates.

8. The switch device of claim 7, in which the groove has a substantially semi-elliptical cross section.

9. The switch device of claim 7, in which the groove has a substantially polyhedral cross section.

10. The switch device of claim 7, in which the groove is formed by etching.

11. The switch device of claim 6, in which the wettable material includes a patterned wettable metal film on at least one of the mated pair of plates.

12. The switch device of claim 6, in which the wettable material includes an electrode.

13. The switch device of claim 6, in which:

the switch device additionally comprises a channel extending from each of the pair of cavities and terminating in an opening in the passage;

the wettable material is located in a portion of the passage between the openings.

14. The switch device of claim 6, in which:

the switch device additionally comprises a channel extending from each of the pair of cavities and terminating in an opening in the passage;

during operation, the non-conductive fluid separates the conductive fluid into non-contiguous conductive fluid portions located in the passage at separation locations on either side of one of the openings; and the wettable material is located in portions of the passage corresponding to the separation locations.

15. A method of making a switch device, the method comprising:

providing a pair of plates, a non-conductive fluid having a high electrical resistance and a conductive fluid having a high electrical conductivity;

forming, in at least one of the plates, a pair of cavities and a passage that allows the pair of cavities to communicate, the passage having a length and a cross-sectional shape, the cross-sectional shape including a corner over at least part of the length;

mating the plates;

placing a portion of the non-conductive fluid in each of the cavities;

placing the conductive fluid in the passage in contact with the portion of the non-conductive fluid in each of the cavities; and forming a wettable film that is wettable by the conductive fluid on at least one of the plates, the wettable film being located adjacent the corner of the cross-sectional shape and extending widthways and lengthways in the passage when the pair of plates is mated.

16. The method of claim 15, in which forming the wettable film includes forming the wettable film on both of the plates, so that when the plates are mated, the wettable film surrounds the passage along at least part of the length of the passage.

17. The method of claim 15, in which, forming the wettable film includes forming the wettable film substantially in the form of a band surrounding the passage.

18. The method of claim 15, in which:

forming the cavities and the passage comprises forming a channel that extends between each of the cavities and the passage, the channel terminating in an opening at the passage;

in forming the wettable film, the wettable film is formed between the openings.

19. The method of claim 15, in which:

forming the cavities and the passage comprises forming a channel that extends between each of the cavities and the passage, the channel terminating in an opening at the passage;

during operation, the non-conductive fluid separates the conductive fluid into portions located in the passage at separation locations on either side of at least opening;

in forming the wettable film, the wettable film is formed in portions of the passage corresponding to the separation locations.

* * * * *